United States Patent [19]

Howell

[11] 4,152,965

[45] May 8, 1979

[54] ORGAN CIRCUIT AND METHOD OF OPERATION

[75] Inventor: Stephen L. Howell, Jasper, Ind.

[73] Assignee: Kimball International, Inc., Jasper, Ind.

[21] Appl. No.: 813,833

[22] Filed: Jul. 8, 1977

[51] Int. Cl.[2] ..... G10F 1/00

[52] U.S. Cl. ..... 84/1.03; 84/1.01; 84/DIG. 2; 84/DIG. 22

[58] Field of Search ..... 84/DIG. 2, DIG. 11, 84/DIG. 22, 1.01, 1.03, 1.24

[56] References Cited

U.S. PATENT DOCUMENTS

| | | | |
|---|---|---|---|
| 3,842,702 | 10/1974 | Tsundoo | 84/DIG. 11 |
| 3,889,568 | 6/1975 | Amaya | 84/DIG. 12 |
| 4,046,047 | 9/1977 | Roberts | 84/1.24 |
| 4,065,993 | 1/1978 | Hirose | 84/DIG. 22 |

*Primary Examiner*—Gene Z. Rubinson
*Assistant Examiner*—Leonard W. Pojunas, Jr.
*Attorney, Agent, or Firm*—Albert L. Jeffers; John F. Hoffman

[57] ABSTRACT

An organ circuit and method of operation in which a detecting system detects combinations of keys played in the accompaniment portion of the keyboard arrangement of an electronic organ and through associated circuitry causes a respective chord to sound regardless of the particular position of the depressed keys or the particular chord inversion represented by the depressed keys.

10 Claims, 3 Drawing Figures

FIG.1
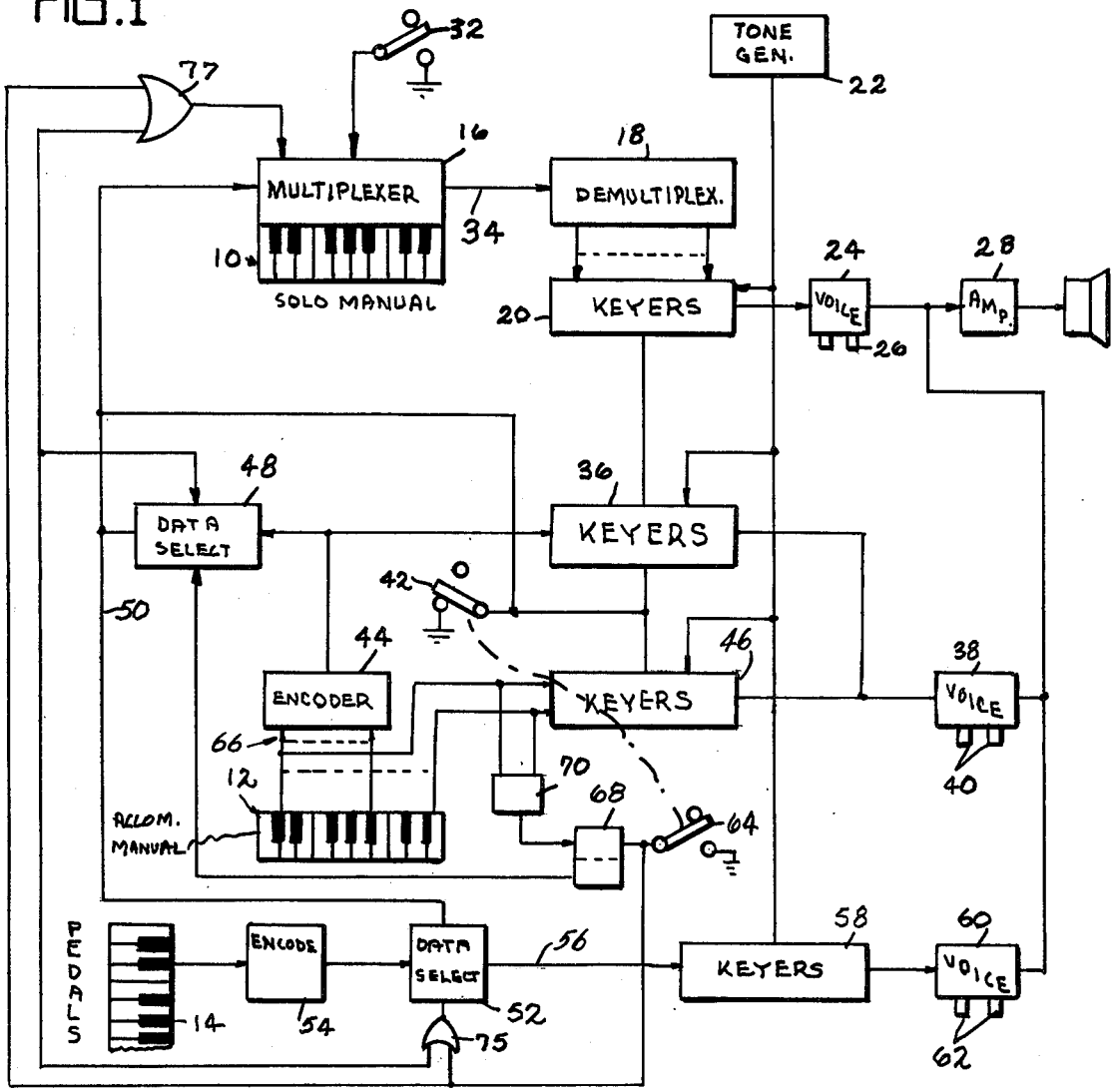
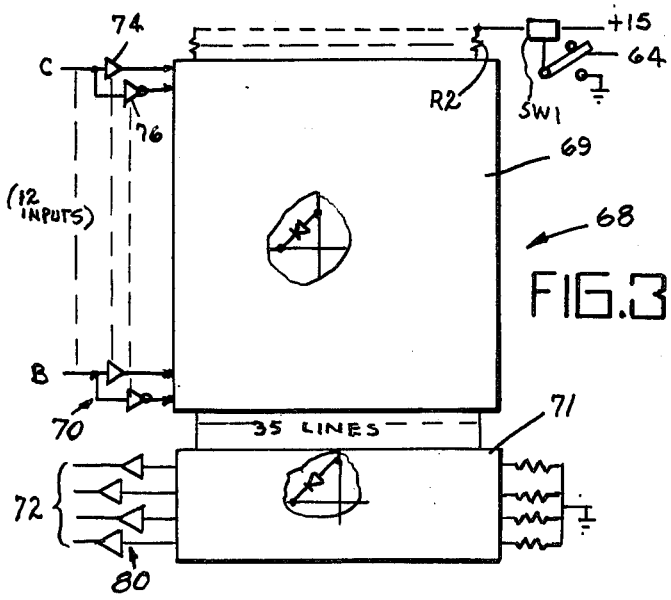
FIG.3
FIG.2
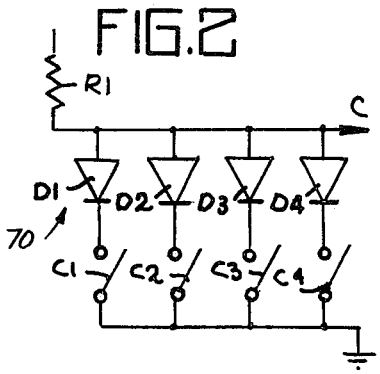

ORGAN CIRCUIT AND METHOD OF OPERATION

The present invention relates to an electronic organ, and to a method of operation thereof, and is particularly concerned with a modification in organ circuitry that represents the transition from an easy play organ to a conventional organ.

Many organs embody easy play features for novices in which, for example, the depressing of a single key of the accompaniment portion of the organ keyboard results in the sounding of a chord in the accompaniment portion or section of the organ keyboard. As skill is developed in respect of playing an organ, it becomes desirable for the player to commence to develop chords by depressing a plurality of keys in the accompaniment portion of the organ keyboard.

Eventually, the depressing of a plurality of keys in the accompaniment section of the keyboard of the organ will result in the player developing the necessary skills to play chords in the proper manner and in the several inversions thereof. However, along with the circuit arrangement that permits chords to be played by the depression of a single key in the accompaniment section of the organ keyboard, there is often provided an arrangement which causes pedal tones to sound in response to the depression of the single accompaniment manual key referred to while it is also known to cause the depression of the single key referred to together with the depression of a key in the right hand section of the organ keyboard to cause "fill" notes to sound in the solo section of the organ keyboard, preferably, within an octave beneath the solo note that is depressed.

When such an organ is adjusted so that the organ player is able to depress a plurality of keys in the accompaniment section to produce chords, the last-mentioned features are lost, and the entire organ plays in a conventional manner. The loss of the easy play features, such as automatic pedal tones and automatic fill notes, as well as other attractive automatic features, make it difficult for the novice or beginner to advance in the art of playing the organ in a step by step manner.

At the present time, the player must either employ all of the easy play features together or must forego at least the important ones if it is desired to expand the technique of manipulating the accompaniment section beyond the playing of single notes.

With the foregoing in mind, the primary objective of the present invention is the provision, in an electronic organ, to permit the organ player to take advantage of automatic features built into an organ while still developing playing techniques, especially pertaining to the left hand or accompaniment manual or accompaniment section of the organ.

BRIEF SUMMARY OF THE INVENTION

According to the present invention, an electronic organ circuit is provided in which conventional operation of the organ can be had with each key controlling a respective pitch or in which the organ can be switched over for automatic operation with certain ones of the keys of the accompaniment manual or section of the organ causing chords to sound with the possibility existing of causing automatic sounding of pedal notes and automatic sounding of fill notes in the solo section.

The present invention provides circuitry pertaining to the accompaniment section which permits operation of the accompaniment section of the organ by the depressing of a plurality of keys at the same time while permitting the aforementioned automatic features, such as the automatic sounding of base notes and the automatic supplying of fill notes, to be maintained.

More particularly, the key switches pertaining to the accompaniment section of the organ are interconnected by connecting diodes so that the depressing of any of certain named keys, such as C keys, will supply a single output signal. By providing a collecting diode arrangement of the nature referred to for each key name, a respective signal will be supplied for each scale note, regardless of the position along the keyboard where the note is depressed.

The twelve signals thus provided for from the accompaniment section of the manual are supplied to a decoding read only memory which supplies a plurality of outputs, each of which is related to a certain combination of keys. Thus, depressing of keys C, E and G will result in the decoding read only memory referred to supplying an output which will result in the sounding of a C major chord. Due to the note collecting diodes pertaining to each named note, it makes no difference where the respective notes are depressed in the accompaniment section or in what inversion the notes of the chord are depressed.

The output in the read only memory is then supplied to a second memory in the form of a decimal to binary code converter and the output from the code converter is supplied to the organ circuitry as a signal for causing a respective chord to sound and, if desired, for fill notes to sound and, for pedal notes to sound automatically. The use of the note collecting diodes and the read only memory and the decimal to binary converter results in the production at the output of the decimal to binary converter of a binary word which corresponds to the binary word which is developed from certain selected keys in the accompaniment section when the organ is adjusted for automatic easy playing.

The exact nature of the present invention will become more clearly apparent upon reference to the following detailed specification taken in connection with the accompanying drawings in which:

FIG. 1 is a schematic view showing an organ circuit modified to include the present invention.

FIG. 2 is a fragmentary view showing the collecting diode arrangement pertaining to one named note of the accompaniment section.

FIG. 3 is a view of a portion of FIG. 1 showing the drivers which connect the diode collectors to the read only memory and also showing the code converter supplied by the read only memory which code converter supplies the control signals for causing chords to sound.

DETAILED DESCRIPTION OF THE INVENTION

Referring to the drawings somewhat more in detail, in FIG. 1, 10 represents the solo manual or solo section of the organ keyboard and 12 indicates the accompaniment manual or accompaniment section. Keyboards 10 and 12 can be in the form of separate manuals or different sections of one and the same keyboard. Section or manual 10 is normally played by the right hand and section or manual 12 is normally played by the left hand. Reference numeral 14 indicates a pedal keyboard or pedal clavier normally played by the organist's feet.

Solo manual 10 has associated therewith a multiplexing system of a known type comprising multiplexer 16, demultiplexer 18, with demultiplexer 18 connected in controlling relation to keyers 20 which are supplied with tone signals from tone generator means 22 and which keyers control the supply of signals to a respective voice circuit means 24 having control tabs 26 for making the respective circuits of the voicing means effective. The output of voicing means 24 passes through amplifier means 28 to speaker means 30.

Multiplexing means 16, when the organ is operating in a conventional manner, provides for actuation of keyers at 20 in conformity with the particular keys of the solo manual which are depressed. However, a switch 32 is provided which, when closed, provides for the data stream supplied by wire 34 from multiplexer 16 to demultiplexer 18 to include keyer actuating signals for causing the sounding of fill notes. The technique of playing fill notes is known and is under the joint control of signals from the accompaniment manual 12 and the solo manual 10.

The accompaniment manual 12 is connected in controlling relation to a further bank of keyers 36 which control the supply of respective tone signals from tone generator 22 to voicing 38 which is under the control of tabs 40. Voicing 38 is also connected to the input side of amplifier 28.

The accompaniment manual is also operable to cause chords to sound in the accompaniment section in response to the depression of predetermined ones of the keys of the accompaniment section or manual. This feature can be made effective by movement of switch 42 to "ON" position and, when effective, a certain group of keys of the accompaniment manual, say, a group at the extreme left end of the accompaniment manual, are encoded in an encoder 44 and the output signal therefrom is supplied as input to a chip 46 interposed between tone generator 22 and voicing 38.

The chip 46 includes keyers, and the signal from encoder 44 is operable to actuate the keyers incorporated in chip 46 so as to cause a chord to sound in the accompaniment section of the organ for each key of group 66 which is depressed. Alternatively, chip 46 could actuate keyers in the bank of keyers at 36 or the keyers pertaining to chip 46 could be entirely separate. In any case, one only of conventional actuation of keyers 36 or actuation of the keyers in a group as by chip 46 is effective at any one time as determined by the setting of switch 42.

When chip 46 is effective, the binary signal supplied from encoder 44, multiplexer 16 is made effective via a control signal from switch 42, for processing the signals on wire 50, received from component 44 via selector 48, in such a manner that the signals will cause fill notes to be sounded in the solo section of the organ within the range of, say, an octave beneath a note that is sounded in the solo section by the depression of a key of manual 10. The causing of the fill notes to sound in the referred to manner is known.

The signal on wire 50 is also supplied to a further data selector 52 pertaining to pedal clavier 14. Normally, pedal clavier 14 supplies a signal, in conformity with the respective pedal which is depressed, to an encoder 54 which, in turn, supplies a binary signal to selector 52. The signal can pass through selector 52 to wire 56 and then to a keyer chip 58 which is interposed between tone generator 22 and voicing 60 which latter is under the control of tabs 62. The output of voicing 60 is supplied to the input side of amplifier 28.

When data selector 52 is actuated via OR gate 75, by movement of switch 42 into effective "ON" position, or by movement of a still further switch 64 into effective "ON" position, the supply of signals from encoder 54 through selector 52 to wire 56 is interrupted and, instead, the signal on wire 50 is supplied to wire 56.

Chip 58 to which wire 56 is connected processes the supply signal and will cause the sounding of notes pertaining to the pedal clavier automatically in response to the depression of any of the keys of the aforementioned group of keys of the accompaniment manual. The group of keys referred to, which might represent up to 31 keys of the accompaniment manual, are indicated over the range designated by reference numeral 66.

The switch 64 previously referred to is also adapted for making effective what can be referred to as an "interpret" chip 68. This chip receives signals from a set of note collecting diodes 70 which receive input signals from the entire accompaniment manual keyboard 12. The output from interpret chip 68 is in the form of a binary word which is supplied by four wire cable 72 to the aforementioned data selector 48.

When switch 64 is closed, a signal is supplied therefrom via an OR gate 77 to the multiplexer chip 16 pertaining to the solo manual which will make this chip effective for playing fill notes regardless of the position of the control switch 42.

It might be pointed out, at this time, that switches 42 and 64 supply signals to both of OR gates 75 and 77 but only switch 64 controls chip 68. The switches 42 and 64 are so interconnected that both cannot be in the "ON" position at the same time, although both can be in the "OFF" position at the same time.

Turning now to FIG. 2, one of the collecting diode arrangements of component 70 of FIG. 1 for one named note of accompaniment manual 12 is shown. This manual might, for example, be four octaves long and thus having four C notes. Switches under the control of the four C notes are indicated at C1, C2, C3 and C4 in FIG. 2. Each of these switches is in series with a respective diode D1, D2, D3 and D4. The four branches are connected in parallel and are in series with a resistor R1 between a plus 5 volt source and ground with the resistor side of the diodes connected to a terminal marked C and which forms one input to a decoding matrix shown in FIG. 3.

It will be apparent that there will be twelve of the note collecting diode arrangements referred to with as many diodes pertaining to each system as there are keys of the respective name in the accompaniment manual.

The twelve, note collector outputs are connected as twelve inputs to the chip which has been generally designated 68 in FIG. 1. The twelve inputs from the note collecting diode arrangements, which are identified by the respective note letters, are each connected via a noninverting driver 74 and an inverting driver 76 with respective lines of the read only memory which forms a portion of chip 68. The noninverting drivers have the outputs "high" when the respective named key is not depressed while the inverting drivers have the outputs "high" when the respective named key is depressed.

The outputs from the drivers 74 and 76 are supplied to a read only memory in the form of a diode matrix having a plurality of vertical lines connected through respective resistors R2 to a switching arrangement SW1 interposed between a plug 15 volt source and resistors R2 and under the control of switch 64. The horizontal lines of the diode matrix are supplied by the drivers 74 and 76 and are connected to the vertical, output, lines of the diode matrix, of which there are thirty-five in the example given, by diodes at certain points as is known in the art of making read only memories.

The diode matrix provides for a plurality of output lines, one pertaining to each resistor R2, with a predetermined group of the lines pertaining to each chord to be recognized by the system. In the particular matrix illustrated, thirty-five chords are recognized, but it will be understood that this is only representative in that the number of chords to be recognized could be extended substantially, merely by increasing the number of output wires from the read only memory and the number of output wires from a decoder to be described hereinafter.

The vertical lines pertaining to resistors R2 and which pertain to the recognized chords are supplied as inputs to a decimal to binary encoder (read only memory) generally designated 71 and forming a part of chip 68. The encoder read only memory 71 supplies a four bit binary word via drivers 80 to line 72 which, it will be seen, is a four wire cable.

It will be appreciated that encoder read only memory 71 could have more output lines if so desired if it became necessary to recognize more chords than are provided for in the illustrated example.

At this point, it will be appreciated that the four bit word supplied by cable 72 to data selector 48 is of the same nature as the four bit word supplied to selector 48 by encoder 44. However, where the four bit word from encoder 44 is developed by the depression of a single one of the keys of group 66, the four bit output from chip 68 is developed in response to the depression of a plurality of keys of the accompaniment manual 12 selected from any region thereof and distributed in any manner.

It will be appreciated, at this point, that the arrangement of the present invention provides for the retention of any desired ones of the automatic play features when the accompaniment manual is provided with a system according to the present invention in which a plurality of accompaniment keys must be depressed to cause a chord to sound. A beginner on the organ, thus, has an opportunity to develop tactile skills without foregoing the use of automatic easy play organ features that enhance the sound and value of the organ.

To summarize, with switches 32, 42 and 64 in the positions shown, the organ will operate in a conventional manner with each key of each manual controlling a respective keyer which, in turn, controls a respective pitch.

When switch 42 is moved to its second, "ON," position, in which the switch blade is connected to ground, the keyers 36 are disabled and keyers 46 are enabled and the group of accompaniment keys at 66 which are connected to encoder 44 will supply signals to keyers 46 so that each of the playing keys in the group 66 of the accompaniment manual will cause a respective accompaniment chord to sound. Also, the data selector at 48 will pass the encoded signal from encoder 44 to multiplexer 16 via wire 50.

If, at this time, switch 32 is moved to its "ON" position with the blade grounded, multiplexer 16 will supply a data stream to demultiplexer 18 which contains key-down signals generated by the data on wire 50 for playing fill notes.

If, now, switch 64 is moved to its "ON" position in which the blade is grounded, interpret chip 68 becomes effective and is actuated in response to signals supplied thereto from the note collector block at 70. Closing of switch 64 will also, via gate 75, actuate data selector 52 pertaining to the pedal manual so that signals on wire 50 will be supplied to keyers 58 instead of encoded signals from the pedal manual encoder 54.

Further, through an OR gate 77 pertaining to multiplexer 16, the multiplexer 16 is enabled for receiving and processing data from wire 50. Still further, the adjustment of switch 64 to the "ON" position supplies a signal to data selector 48 so that, instead of the output of encoder 44 passing through data selector to line 50, the output of the interpret chip 68 is supplied to wire 50.

It will be apparent that, when interpret chip 68 is enabled, the chord sounded in the accompaniment manual will be made up by depressing named keys corresponding to the names of notes making up the chord. At the same time, an encoded signal is supplied via data selector 48 to make effective any of the automatic features pertaining to the organ such as the sounding of fill notes or the sounding of pedal notes. It will be understood that many special automatic play features that are normally controlled by the left hand or accompaniment manual can be controlled as disclosed herein.

It will also be apparent that each keyboard of the electronic organ is made up of playing keys which are grouped in octaves with corresponding keys in the octaves bearing the same name. Reference to a named key in the appended claims is intended to mean any key having the same name, such as any C key or any D key.

In respect of the operation of the chip 68, it has been explained that this has a read only memory portion, indicated at 69, which is addressed by the outputs of the note collectors of which one is shown in FIG. 2 and that read only memory 69, in turn, addresses a second read only memory 71 which is, in effect, a decimal to binary encoder.

It has been further mentioned that read only memory 69 recognizes thirty-five chords and, for this reason, has thirty-five wires forming outputs that serve as inputs to encoder 71.

Each vertical wire of read only memory 69 is connected via a respective resistor R2 with a fifteen volt source but is normally held low by the diodes connecting each vertical line with at least one of the driver lines extending from the inverting drivers 76.

When a chord is played on the organ, for example, the C major triad, the noninverting driver 74 thereof causes the respective horizontal lines of memory 69 to go low while the outputs from the respective inverting drivers go high. The noninverting drivers have no connections with the vertical line pertaining to the C major triad while each of the inverting drivers is connected with the respective vertical line by a diode as is shown in FIG. 3. Thus, if notes C, E and G are depressed in whatever portion of the accompaniment manual, one of the thirty-five output lines at the bottom of read only memory 69 will go high provided, however, that none of the other keys of the accompaniment manual are depressed.

If any other key is depressed, it will be found that a diode connecting the noninverting driver pertaining to the respective other key with the vertical line of the read only memory will cause the line to go low and thus to prevent actuation of decoder 71.

The read only memory 69 is thus arranged to represent thirty-five different combinations of notes with each combination driving a respective output line of the read only memory high when, and only when, no other key of the accompaniment manual is depressed.

A certain amount of redundancy will be found in the output from the encoder 71 because, for example, on occasion, certain chords, for example, seventh chord might be played without the root and in which case the same four bit output word from encoder 71 is desired for the same special effects that will be played along with the same seventh chord having the root included.

It will be apparent from the foregoing that an organ equipped according to the present invention provides a player with the means for playing the easy play features of the organ by making encoder 44 effective, in which case each of a certain group of keys of the accompaniment manual will cause a chord to sound and will also generate a four bit control word to control other easy play features that might be incorporated in the organ.

Alternatively, the chord playing by depression of single keys on the accompaniment manual can be eliminated and, instead, the interpret chip according to the present invention made effective, and in which case the accompaniment notes corresponding to the keys depressed in the accompaniment manual will sound and, when any combination of accompaniment notes corresponding to any of the recognized chords are depressed, a corresponding four bit word will be generated which will be routed within the organ system for controlling easy play or special effect features other than the single note chord playing.

As used in the claims, the term "keyboard" means a group of keys spanning more than one octave, such as the solo manual, accompaniment manual, pedalboard, or any group of consecutive keys forming a portion thereof.

Modifications may be made within the scope of the appended claims.

What is claimed is:

1. In an electronic organ having a keyboard comprising a plurality of playing keys arranged in octaves with corresponding keys in each octave being associated with the same note name, the improvement comprising: note collector means operatively associated with said keyboard for developing a multiple bit binary word wherein the individual bit locations of said word correspond, respectively, to individual groups of said keys associated with a particular note name, said collector means producing a keydown logic level at the bit locations in said word corresponding to a plurality of actuated keys of the corresponding note names anywhere on said keyboard, and encoder means connected to said collector means and responsive to said binary word for producing a respective control signal for each of a plurality of said binary words.

2. The electronic organ of claim 1 wherein said control signals are binary control words, and including: key encoding means connected to said playing keys and operable to develop a respective binary control word in response to and actuation of a playing key, data selector means having an input connected to each encoder means and having output, and also having a control terminal for connecting the inputs selectively to said output, and mode selector means having respective positions in which each said encoder means is effective and the data selector control terminal is actuated to cause the binary control word developed by the effective encoder means to be applied to the output of said data selector.

3. In an electronic organ having keyboard means comprising a plurality of playing keys consisting of a plurality of groups of named playing keys with the corresponding playing keys in each group being associated with the same note name, the improvement comprising: encoder means connected to said keys to receive a plurality of signals therefrom wherein the individual signals each pertain to the playing keys of a respective name which are depressed, means for storing a plurality of binary code words corresponding, respectively, to a plurality of chords, said encoder means recognizing a plurality of combinations of said signals received from said keyboard and its respective chords and being operable, in response to a given combination of signals, to select the said stored code word corresponding to the chord associated with the given recognized combination of signals.

4. In an electronic organ having a keyboard comprising a plurality of playing keys consisting of a plurality of groups of named playing keys with the corresponding playing keys in each group being associated with the same note name, the improvement being a method of operation comprising: receiving from the keys a plurality of signals wherein the individual signals each pertain to the playing keys of respective name which are depressed, storing a plurality of binary code words corresponding, respectively, to a plurality of chords, recognizing a plurality of combinations of the signals received from the keyboard and its respective chords and being operable, in response to a given combination of said signals, to select the said stored code word corresponding to the chord associated with the given recognized combination of signals.

5. An electronic organ according to claim 1 in which said encoder means includes a decimal encoder connected to the playing keys and a decimal to binary converter connected to the decimal encoder and developing said control signals.

6. An electronic organ according to claim 1 in which said encoder means includes a decimal encoder comprising a matrix having a pair of lines for each said key and another line intersecting said pairs of lines, diodes connecting said lines at the points of intersection thereof, said decimal to binary converter comprising terminals at which said control signal is developed and connected via diodes to groups of said other lines.

7. An electronic organ according to claim 1 in which said encoder means comprises a first memory having an input terminal for each said playing key, note collector means for supplying a signal to the respective input terminal in response to the depression of any of the correspondingly named playing keys, said memory having a plurality of output terminals at each of which there is developed a signal in response to the depression of a predetermined group of keys, a second memory for converting the output of the first memory to binary form, said second memory having input terminal means connected to the output terminals of said first memory and having output terminal means at which a said control signal is developed for each signal supplied thereto from said first memory.

8. An electronic organ according to claim 7 in which each said note collector means is formed by a circuit branch comprising a diode and a switch in series for each of the respective playing keys and connected in parallel between a source of voltage and ground, and a connection from a point on each note collector means which changes in voltage when one of the pertaining playing keys is depressed to actuate the respective switch to the respective input terminal of said first memory.

9. An electronic organ according to claim 2 in which said organ includes automatic play features under the control of the control word at the output of said data selector.

10. An electronic organ according to claim 2 in which said selector means also has a position in which neither encoder means is effective and, instead, the playing keys are operable for actuating respective keyers to control the production of sound.

* * * * *